US008919560B2

(12) United States Patent
Hopkins

(10) Patent No.: US 8,919,560 B2
(45) Date of Patent: Dec. 30, 2014

(54) CHEWING GUM DISPOSAL CONTAINER

(71) Applicant: Derek L. Hopkins, Tustin, CA (US)

(72) Inventor: Derek L. Hopkins, Tustin, CA (US)

( * ) Notice: Subject to any disclaimer, the term of this patent is extended or adjusted under 35 U.S.C. 154(b) by 0 days.

(21) Appl. No.: 13/915,846

(22) Filed: Jun. 12, 2013

(65) Prior Publication Data

US 2013/0334088 A1 Dec. 19, 2013

Related U.S. Application Data

(60) Provisional application No. 61/659,102, filed on Jun. 13, 2012.

(51) Int. Cl.
*B65F 1/14* (2006.01)
*B65F 1/00* (2006.01)

(52) U.S. Cl.
CPC ... *B65F 1/14* (2013.01); *B65F 1/00* (2013.01); *B65F 2240/14* (2013.01)
USPC ..... 206/496; 206/460; 206/216; 229/87.07; 229/87.01; 229/82; 229/80.5; 229/77; 229/68.1; 426/335; 426/326

(58) Field of Classification Search
CPC ..... B65D 27/00; B65D 27/04; B65D 27/08; B65D 27/14; B65D 27/16; B65D 27/30; B65D 27/32; B65D 2571/0016; B65D 2571/00327; B65D 2571/0066; B65D 2571/0079; B65D 2571/0082; A47K 10/16; A47K 10/421; A47K 10/46; A47K 2010/3266; B65F 1/00; B65F 1/14; B65F 2240/14
USPC ..... 206/37, 200, 216, 246, 364, 455, 457, 206/460, 496, 527, 570–571, 800, 806, 206/813; 229/5.82, 68.1, 71–72, 75, 77, 80, 229/80.5, 82, 84, 87.01, 87.07, 92.1, 92.3, 229/92.7–92.8; 426/5, 133, 326, 335
See application file for complete search history.

(56) References Cited

U.S. PATENT DOCUMENTS

| | | | | |
|---|---|---|---|---|
| 1,461,635 | A * | 7/1923 | Szczerba | 229/80 |
| 1,683,584 | A * | 9/1928 | Hogan | 383/38 |
| 2,112,748 | A * | 3/1938 | Berkowitz | 229/80 |
| 2,251,391 | A * | 8/1941 | Berkowitz | 229/80.5 |
| 3,017,063 | A * | 1/1962 | Rooney | 206/496 |
| 3,882,868 | A * | 5/1975 | Tundermann | 604/293 |
| 4,244,511 | A * | 1/1981 | Coleman | 229/92.1 |
| 5,407,685 | A * | 4/1995 | Malchesky et al. | 424/449 |
| 7,334,719 | B1 * | 2/2008 | Fisher | 229/80.5 |
| 7,380,666 | B1 * | 6/2008 | Buckelew | 206/527 |
| 2002/0064542 | A1 * | 5/2002 | Deckner et al. | 424/404 |
| 2003/0150766 | A1 * | 8/2003 | Smith | 206/527 |
| 2004/0173475 | A1 * | 9/2004 | Shimko | 206/233 |
| 2006/0051457 | A1 * | 3/2006 | Bougoulas et al. | 426/5 |

(Continued)

*Primary Examiner* — Mickey Yu
*Assistant Examiner* — Brijesh V. Patel

(57) ABSTRACT

A chewing gum disposal container is provided as simple, easy to use, and convenient apparatus for disposing used gum in areas where traditional methods of gum disposal are not readily available. The apparatus is provided as an envelope that forms an inner chamber. The inner chamber is utilized for receiving used chewing gum and is lined with an antimicrobial layer that reduces the transmission of infectious disease. The envelope utilizes a front section and a rear section in order to form the inner chamber. The front section provides a top flap that seals the inner chamber. Additionally the front section provides a visual identifier for distinguishing the particular apparatus.

1 Claim, 9 Drawing Sheets

(56) References Cited

U.S. PATENT DOCUMENTS

2008/0311322 A1* 12/2008 Haskin et al. ..... 428/35.2
2009/0294321 A1* 12/2009 Craig et al. ..... 206/496
2010/0047405 A1* 2/2010 Versteylen et al. ..... 426/124
2012/0247997 A1* 10/2012 Thomas ..... 206/457

* cited by examiner

CHEWING GUM DISPOSAL CONTAINER

The current application claims a priority to the U.S. Provisional Patent application Ser. No. 61/659,102 filed on Jun. 13, 2012.

FIELD OF THE INVENTION

The present invention relates generally to disposal containers. More particularly, it is the object of the present invention to provide a cheap and effective means of quick and convenient disposal of chewing gum.

BACKGROUND OF THE INVENTION

Many people enjoy the flavor and oral activity offered by chewing gum. However this is one major issue that arises when a person is finished chewing their gum. The problem is the fact that the gum must be disposed of in some way shape or form. The usual solution to this problem is for the person to seek out a trash can or a piece of paper into which to deposit the chewed gum. However, many gum chewers can find themselves in situations where a trash can or disposable piece of paper is not readily available such as at a poolside, or in a fine restaurant with cloth napkins and the only trashcans in the restrooms. When a quick and convenient way to dispose of the gum is not available, there are several less sanitary methods employed by some people. Methods such as simply throwing the gum on the ground where it will stick to the ground, and most likely ruin the bottom of another's shoe, or worse, the gum may be stuck under a table. Sticking gum under a table is highly unsanitary as the gum is open to environment where an unsuspecting person may accidentally touch the gum. This contact between the exposed gum under the table and the person may at best cause discomfort for the person as the chewed gum disgusts the person, and at worse may spread infectious diseases from the saliva that may be present on the chewed gum.

It is therefore the object of the present invention to provide a simple, easy to use, and convenient method of gum disposal. The chewing gum disposal container is designed to be used in areas where traditional methods of gum disposal such as paper or trash cans are not readily available. Specific examples of these situations include a table at a fine restaurant, at a poolside, on a cruise ship, or in a hotel lobby. In said situations, the will provide people with a means of quickly and conveniently disposing of their unwanted chewing gum, which ultimately promotes sanitary conditions in the areas where used gum disposal envelopes are utilized.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
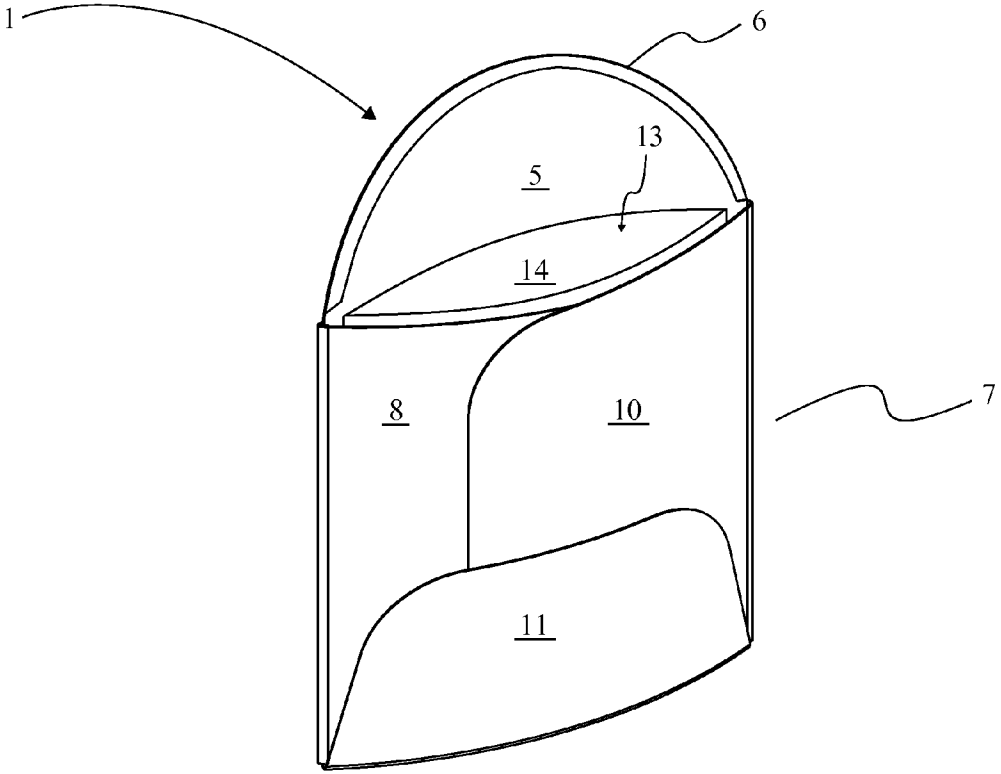
FIG. 1 is a perspective view displaying the inner chamber formed by the front section and the rear section as per the current embodiment of the present invention.

In reference to FIG. 1, the present invention is a chewing gum disposal container that is simple, easy to use, and a convenient method of disposing of used gum that is designed to be used in areas where traditional methods of gum disposal such as paper or trash cans are not readily available. The chewing gum disposal container comprises an envelope 1 and an inner chamber 13. The envelope 1 is provided as the peripheral structure that surrounds a user's used chewing gum. The inner chamber 13 is provided as the interior region of the chewing gum disposal container in which a user's deposits the used chewing gum. The envelope 1 is provided with an opening towards the inner chamber 13 that can be closed after the user deposit the used chewing within the inner chamber 13.

Figure 4:
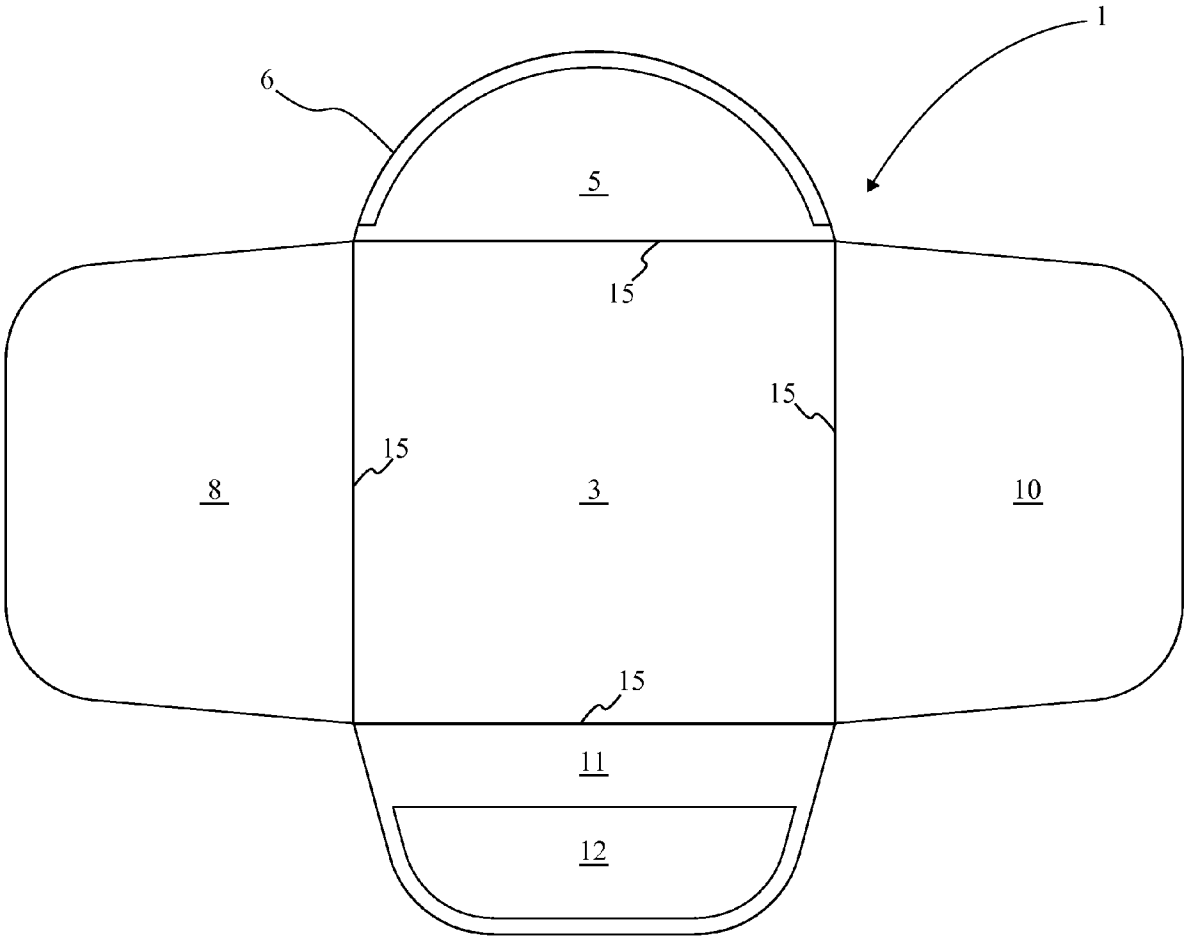
FIG. 4 is a top down elevational view displaying the rear section of the envelope in an unfolded configuration as per the current embodiment of the present invention.
Figure 5:
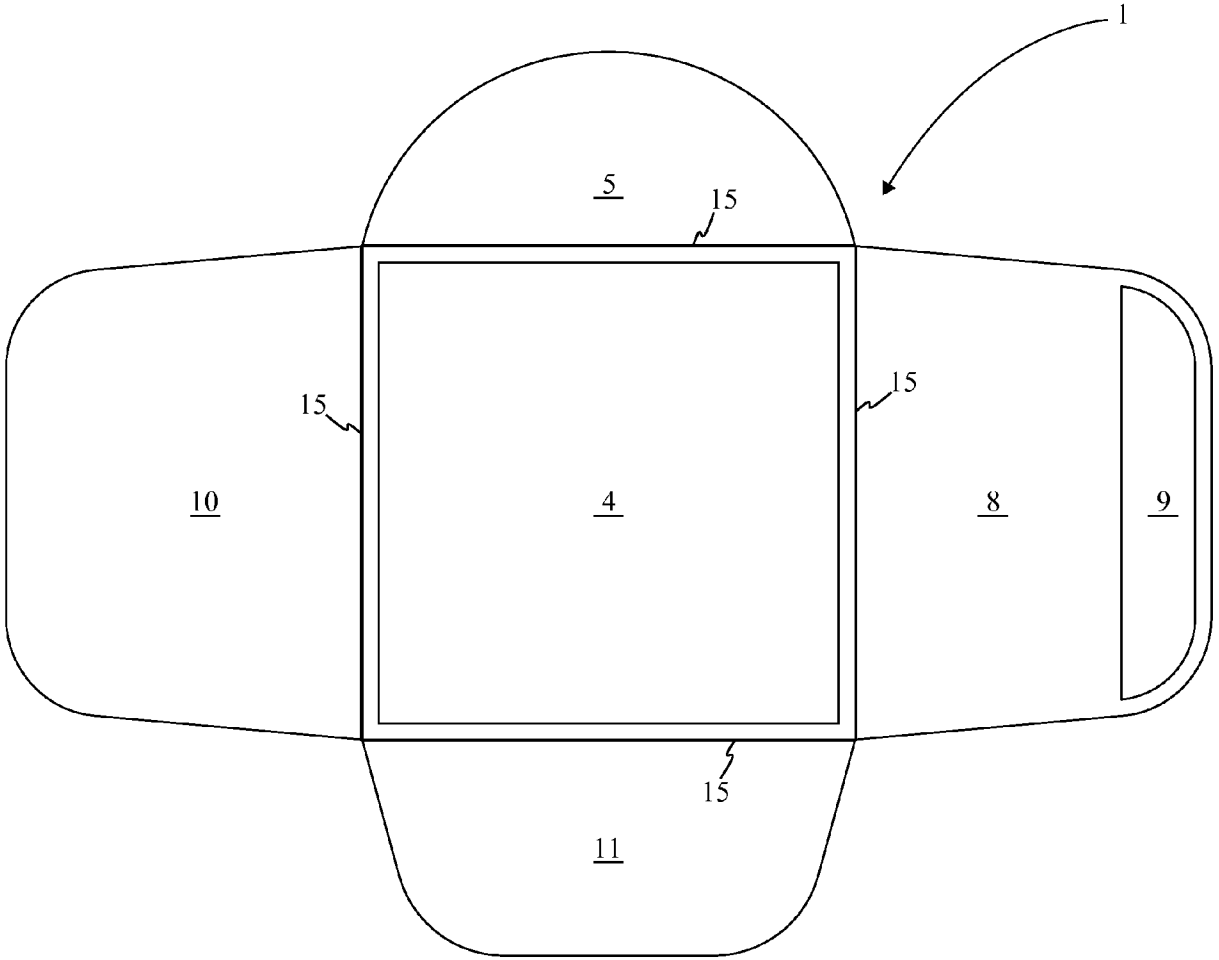
FIG. 5 is a top down elevational view displaying the front section of the envelope in an unfolded configuration as per the current embodiment of the present invention.

In reference to FIG. 4 and FIG. 5, the envelope 1 in the current embodiment of the present invention comprises a front section 2 and a rear section 7. The front section 2 and the rear section 7 are provided as complementary that form the inner chamber 13. The front section 2 and the rear section 7 are found positioned parallel to one another. In the current embodiment of the present invention, the front section 2 comprises a center section 3 and a top flap 5 while the rear section 7 comprises a first lateral flap 8, a second lateral flap 10, and a bottom flap 11. The first lateral flap 8, the second lateral flap 10, and the bottom flap 11 are parallel positioned components that are generally planar in shape. The first lateral flap 8, the second lateral flap 10, and the bottom flap 11 are provided as interlocking components whose engagement forms the rear section 7. The first lateral flap 8, the second lateral flap 10, and the bottom flap 11 are found coupled to the front section 2 by way of the center section 3. The center section 3 is a planar surface that is rectangular in shape and function as the attachment point for the components of the rear section 7. The top flap 5 is peripherally positioned to the center section 3. The top flap 5 is also generally planar in shape and functions as the portion of the front section 2 that becomes coincident with the rear section 7. Through the engagements between the first lateral flap 8, the second lateral flap 10, the bottom flap 11, and the top flap 5, the inner chamber 13 is completely enclosed.

Figure 2:
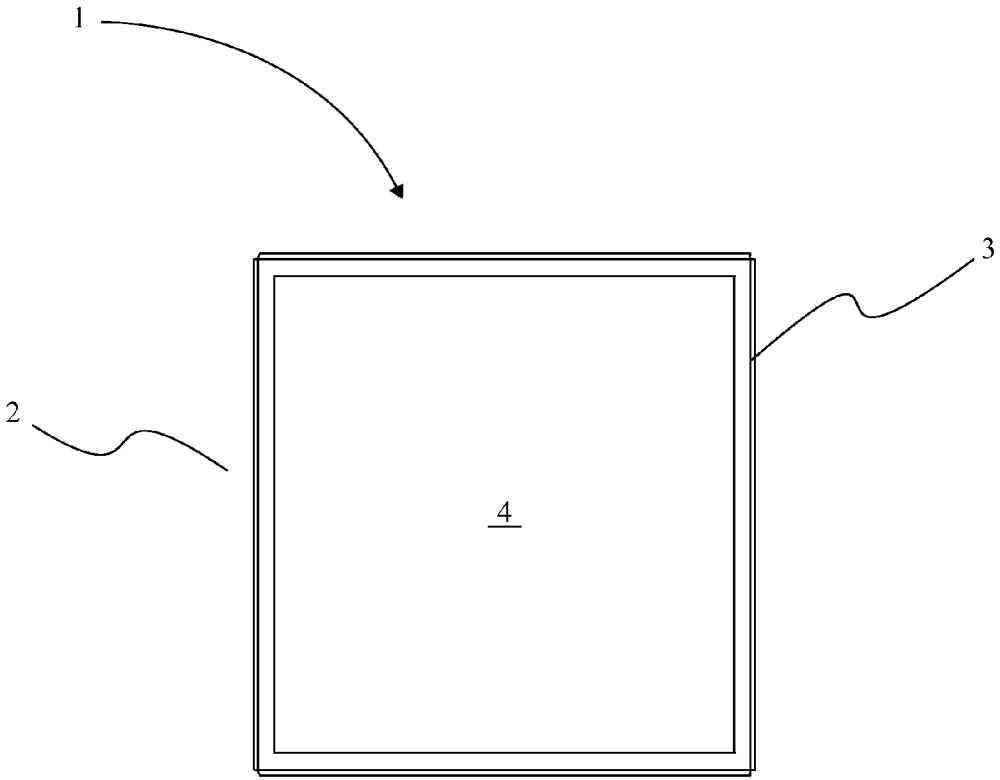
FIG. 2 is a top down elevational view displaying the front section with the top flap folded parallel to the rear section as per the current embodiment of the present invention.

In reference to FIG. 2 and FIG. 5, the front section 2, in the current embodiment of the present invention, comprises the top flap 5 and the center section 3. The center section 3 is provided as the attachment point for the first lateral flap 8, the second lateral flap 10, and the bottom flap 11. In the current embodiment of the present invention, the center section 3 comprises a visual identifier 4. The visual identifier 4 is a portion of the center section 3 that can be used to brand or distinguish individual chewing gum disposal containers for advertising campaigns. The visual identifier 4 is found positioned on the center section 3 opposite the rear section 7. The top flap 5 is provided as a peripherally positioned component to the center section 3 that is pivotally engaged to the center section 3. The pivotal engagement permits the top flap 5 to become coincident with the rear section 7, allowing a user to enclose the inner chamber 13. The top flap 5 is coincident with the first lateral flap 8 and the second lateral flap 10 along a pivot path 15 provided by the pivotal engagement to the center section 3. In the current embodiment of the present invention, the top flap 5 comprises an adhesive strip 6. The adhesive strip 6 is provided as a means of securely retain the top flap 5 to the rear section 7. The adhesive strip 6 is found positioned on the portion of the top flap 5 that becomes coincident with the rear section 7. The adhesive strip 6 enables the top flap 5 to be retained to the first lateral flap 8 and the second lateral flap 10.

Figure 6:
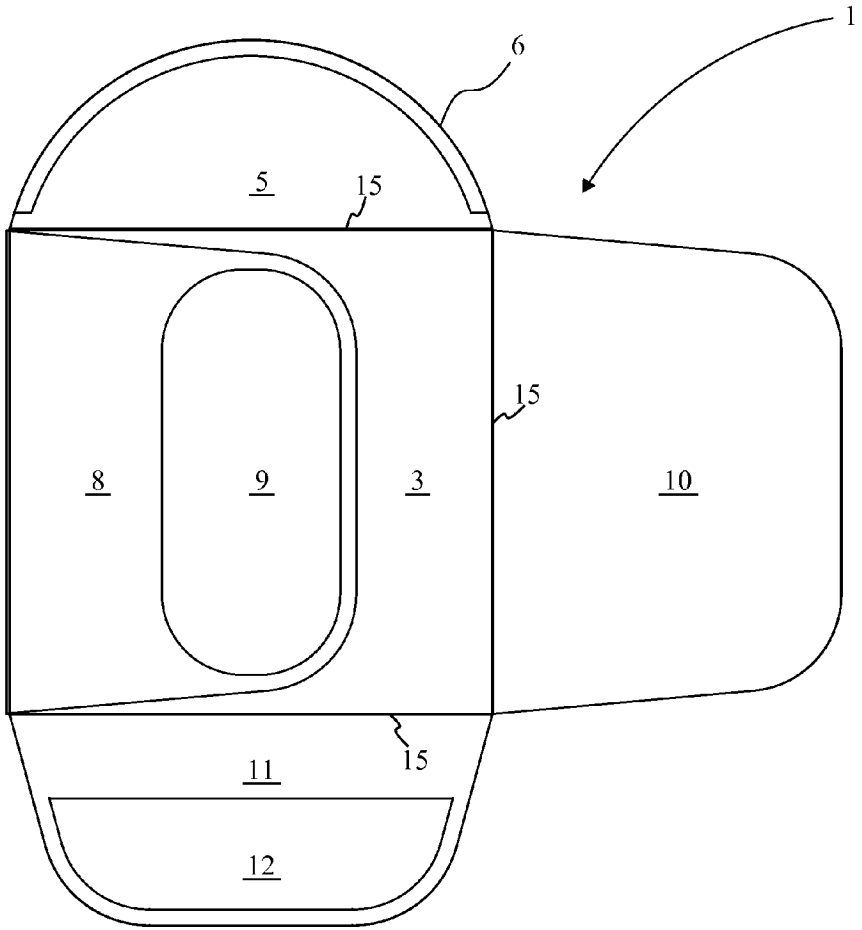
FIG. 6 is a top down elevational view displaying the formation of the rear section with the first lateral flap folded parallel to the front section as per the current embodiment of the present invention.
Figure 7:
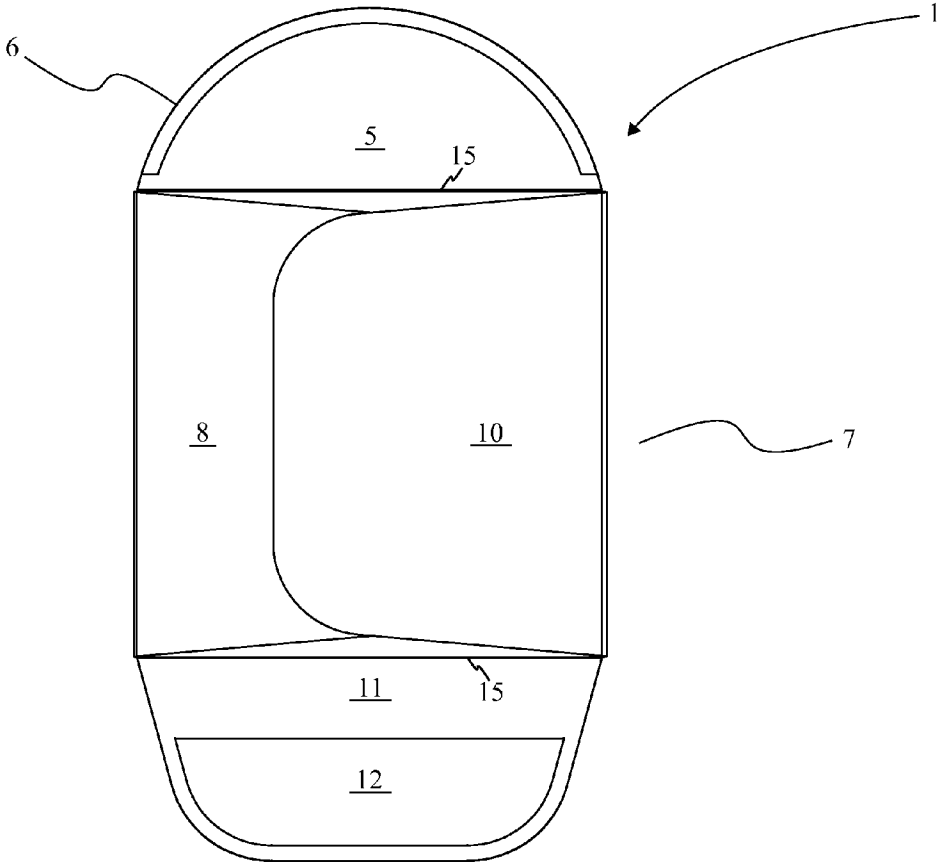
FIG. 7 is a top down elevational view displaying the formation of the rear section with the second lateral flap folded parallel to the first lateral flap as per the current embodiment of the present invention.

In reference to FIG. 6 and FIG. 7, the rear section 7, in the current embodiment of the present invention, comprises the first lateral flap 8, the second lateral flap 10, and the bottom flap 11. The bottom flap 11 is found pivotally coupled to the center section 3 opposite the top flap 5. The bottom flap 11 is found positioned between the first lateral flap 8 and the second lateral flap 10. The first lateral flap 8 is found pivotally engaged to the center section 3. The second lateral flap 10 is also found pivotally engaged to the center section 3 opposite the first lateral flap 8. The pivotal engagement between the center section 3 and the components of the rear section 7 provide the first lateral flap 8, the second lateral flap 10, and the bottom flap 11 with a means of becoming parallel to one another. The pivotal engagement to the center section 3 for the first lateral flap 8 and the second lateral flap 10 enables the first lateral flap 8 to become engaged parallel to the second lateral flap 10. To enable the parallel engagement, the first lateral flap 8 and the second lateral flap 10 is provided with sufficient length in order to overlap forming an area of interface when parallel. Additionally the pivotal engagement between the bottom flap 11 with the first lateral flap 8 and the second lateral flap 10 enables the bottom flap 11 to form a parallel engagement with the first lateral flap 8 and the second lateral flap 10. To enable the parallel engagement, the bottom flap 11 is sufficient length in order to overlap both the first lateral flap 8 and the second lateral flap 10 forming an area of interface when parallel.

Figure 8:
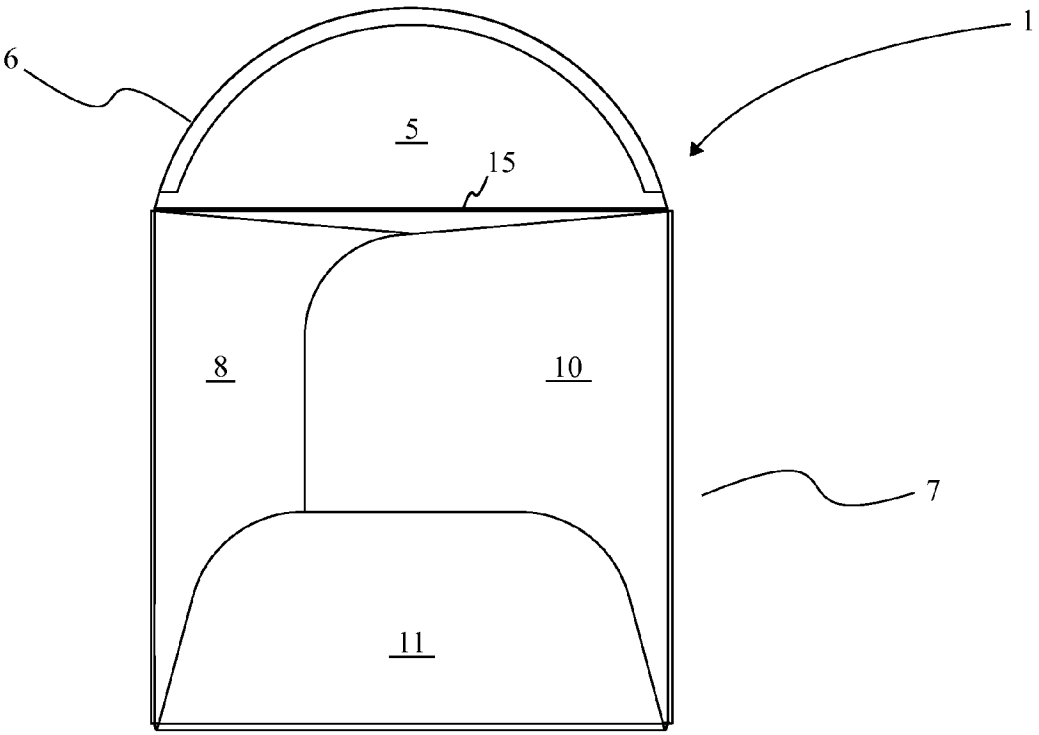
FIG. 8 is a top down elevational view displaying the rear section with the bottom flap folded parallel to the first lateral flap and the second lateral flap as per the current embodiment of the present invention.
Figure 9:
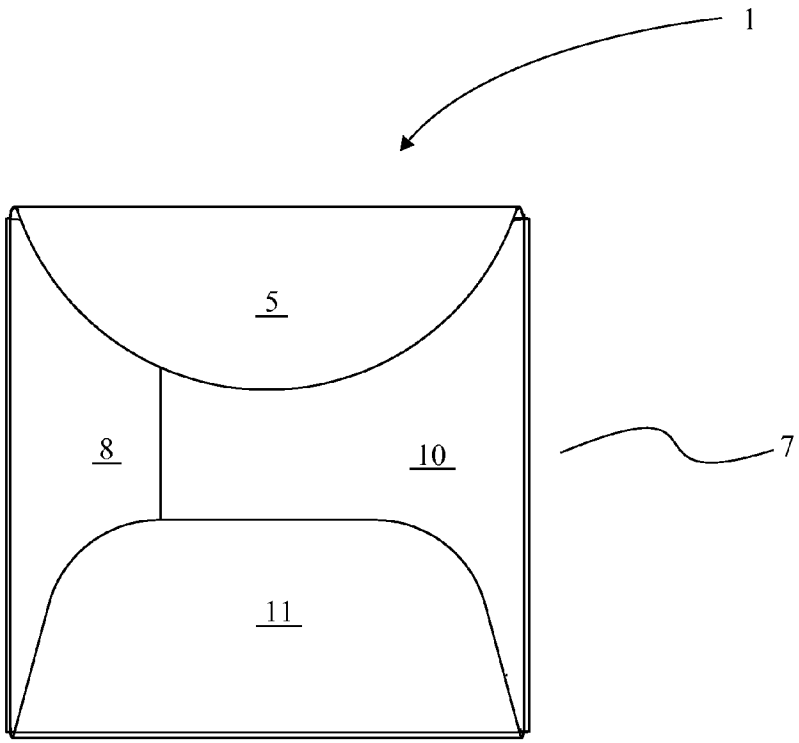
FIG. 9 is a top down elevational view displaying the rear section with the top flap folded parallel to the rear section as per the current embodiment of the present invention.

In reference to FIG. 8 and FIG. 9, the first lateral flap 8, the second lateral flap 10, and the bottom flap 11, in the current embodiment of present invention, are found engaged parallel to one another. The parallel engagement permits the first lateral flap 8, the second lateral flap 10, and the bottom flap 11 to form the envelope 1 that encloses the inner chamber 13. In the current embodiment of the present invention, the first lateral flap 8 and the second lateral flap 10 are retained to each other through the use of an adhesive coupler 9. The adhesive coupler 9 is a means of securely engaging both components through their area of interface when positioned parallel to each other. Similarly, bottom flap 11 is retained to both the first lateral flap 8 and the second lateral flap 10 through the use of another adhesive coupler 12. The other adhesive coupler 12 securely engages the bottom flap 11 to the first lateral flap 8 and the second lateral flap 10 through their area of interface when three components are positioned parallel to each other.

Figure 3:
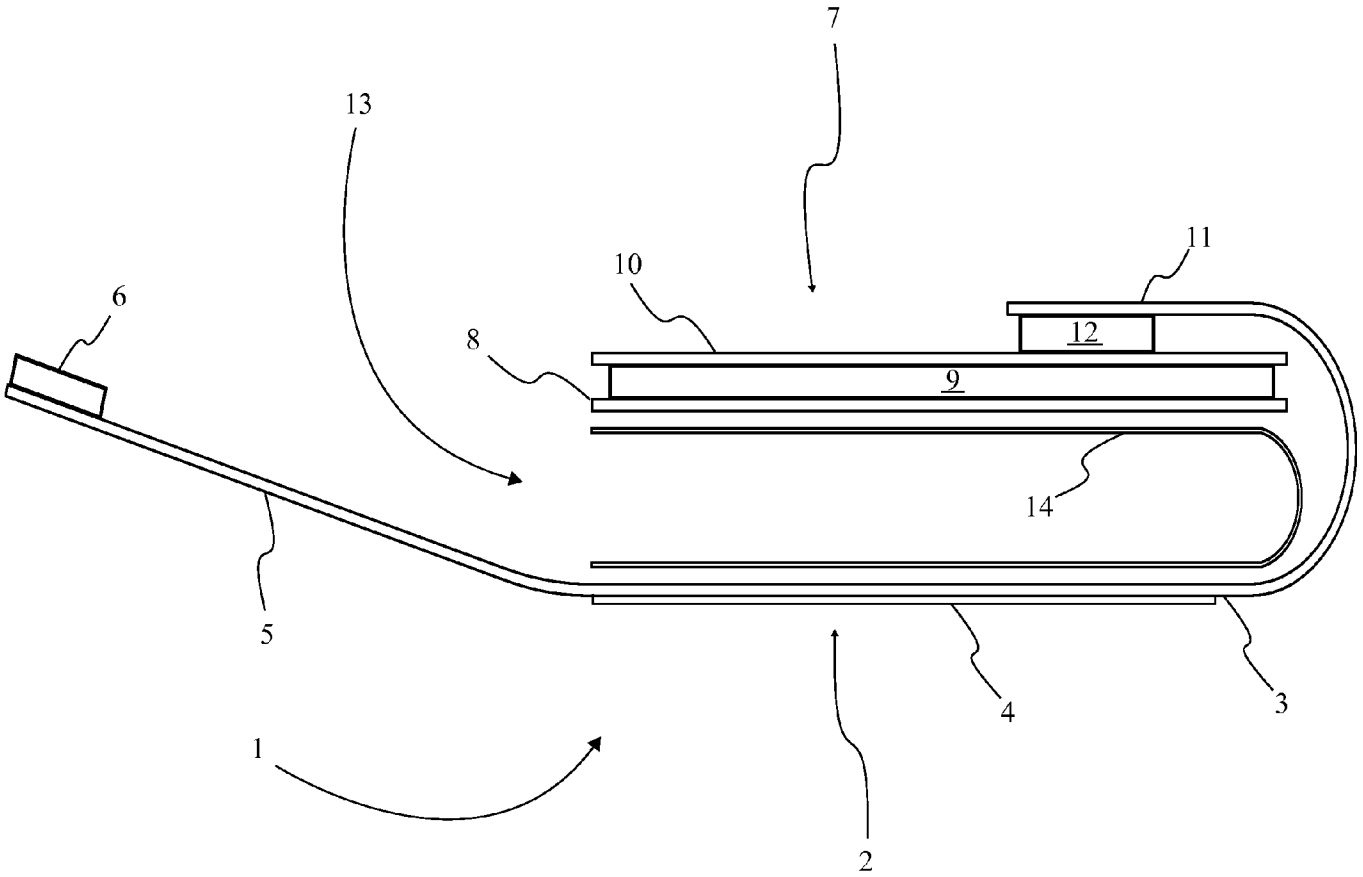
FIG. 3 is a cross sectional view displaying a representation of the component distribution of the chewing gum disposal container as per the current embodiment of the present invention.

In reference to FIG. 1 and FIG. 3, the inner chamber 13, in the current embodiment of the present invention, is the region formed between the front section 2 and the rear section 7 that receives and holds used chewing gum. The inner chamber 13 comprises an antimicrobial layer 14. The antimicrobial layer 14 is provided as a means of reducing the microbial presence in used chewing gum deposited within the inner chamber 13. The antimicrobial layer 14 is found peripherally positioned to the front section 2 and the rear section 7. The peripheral positioning provides the antimicrobial layer 14 with greater surface area in order to engage used chewing gum deposited within the inner chamber 13. In the current embodiment of the present invention, the anti microbial layer is provided as moisture activated antiviral tissue paper. The moisture activated antiviral tissue paper provides the antiviral characteristic upon being activated by moisture from the chewing gum.

In the preferred embodiment of the present invention, the center section 3 is a flat, square piece with the top flap 5, the bottom flap 11, the first lateral flap 8 and the second lateral protruding off each edge of the square. The visual identifier 4 allows any type of branding or advertisement for an establishment in which the present invention is used. The visual identifier 4 may be affixed to the center section 3 or printed to front section 2. This advertisement space adds to the appeal of the present invention for small businesses.

In the preferred embodiment of the present invention, the first lateral flap 8 is connected to the right edge of the center section 3, the second lateral flap 10 is connected to the left edge of the center section 3, the bottom flap 11 is connected to the bottom section of the center section 3, and the top flap 5 is connected to the top section of the center section 3. Together, the center section 3 and four flaps make up the body of the present invention and can, by the nature of the design of the present invention, all be manufactured out of the same sheet of material. The first lateral flap 8 and second lateral flap 10 are folded such that they are parallel and flush to the surface of the center section 3. The first lateral flap 8 and second lateral flap 10 must be of sufficient length such that when the first lateral flap 8 and second lateral flap 10 are folded in, an area of interface where the first lateral flap 8 contacts the second lateral flap 10 is formed. The area of interface is critical to the function of the preferred embodiment of the present invention as the area of interface is where adhesive will be applied to secure the flaps together. The bottom flap 11 is folded up over the first lateral flap 8 and second lateral flap 10. Again it is necessary that the bottom flap 11 forms an area of interface with the first lateral flap 8 and second lateral flap 10 where adhesive will be applied to keep the bottom flap 11 in the folded position. The top flap 5 is free to bend about the edge of the center section 3 that the top flap 5 is connected to. The top flap 5 must remain free to bend in order to allow chewed gum to be deposited on the inside of the present invention.

In the preferred embodiment of the present invention, the moisture activated tissue paper is peripherally positioned within the inner chamber 13. The antiviral tissue paper is imbued with a concentration of water soluble metal ions. The metal ion dissolves in the saliva found in the used chewing gum enabling it to interact with certain viral strains such as influenza. In an additional embodiment of the present invention, the antiviral tissue paper is provided with an additional piece of paper that contains no antiviral characteristic. The additional piece of paper offers a removable component into which used gum may be spat into and then inserted into the inner chamber 13.

In an additional embodiment of the present invention, the envelope 1 is constructed using a scented paper. The scented paper provides a pleasing aroma and increases the incentive to utilize the present invention for gum disposal needs. This added incentive increases use of the present invention and decreases the number of people who employ less sanitary means of gum disposal. Additionally, the scented paper could potentially be moisture activated such that moisture from saliva activates or increases the diffusion of a particular scent.

In an additional embodiment of the present invention, a moisture activated adhesive could be used as the adhesive strip 6 utilized by the top flap 5. The moisture activated adhesive allows the user to seal the inner chamber 13 through the use of the moisture contained within the used chewing gum.

In an additional embodiment of the present invention, the first lateral flap 8, the second lateral flap 10, and the bottom flap 11 would be retained together by using the used chewing gum deposited within the inner chamber 13. In order to enable said functionality a center hole would be provided for first lateral flap 8, the second lateral flap 10, and the bottom flap 11. Each center hole would be provided with a concentric positioning when the first lateral flap 8, the second lateral flap 10, and the bottom flap 11 are positioned parallel to one another. In order to operate the aforementioned additional embodiment, the user would deposits used chewing gum onto the center section 3 and then proceed to fold the first lateral flap 8, the second lateral flap 10 and finally the bottom flap 11 on top of the used chewing gum. The top flap 5 is folded down last, covering the hole through the other three flaps and being adhered to the center section 3 by way of the used chewing gum protrudes through the center hole. This additional embodiment of the present invention would require the anti microbial layer to be infused onto the surfaces of the center section 3, first lateral flap 8, second lateral flap 10, bottom flap 11, and top flap 5 proximal to the used chewing gum.

Although the invention has been explained in relation to its preferred embodiment, it is to be understood that many other possible modifications and variations can be made without departing from the spirit and scope of the invention as hereinafter claimed.

What is claimed is:

1. A chewing gum disposal container comprises:

an envelope;

an inner chamber;

the envelope comprises a front section and a rear section;

the inner chamber comprises an antimicrobial layer, wherein the antimicrobial layer consists of a moisture activated antiviral tissue paper;

the front section comprises a center section and a top flap;

the rear section comprises a first lateral flap, a second lateral flap, and a bottom flap;

the center section comprise a visual identifier;

the interior chamber being surrounded by the envelope;

the front section being positioned parallel to the rear section;

the antimicrobial layer being peripherally positioned to the front section and the rear section;

the inner chamber being formed by the front section and the rear section;

the first lateral flap, the second lateral flap, and the bottom flap being coupled to the front section;

the visual identifier being positioned opposite the rear section;

the top flap being peripherally positioned to the center section;

the top flap being pivotally connected to the center section;

the bottom flap being pivotally connected to the center section opposite the top flap;

the bottom flap being positioned between the first lateral flap and the second lateral flap;

the first lateral flap being pivotally connected to the center section;

the second lateral flap being pivotally connected to the center section opposite the first lateral flap;

the first lateral flap being engaged parallel to the second lateral flap;

the bottom lateral flap being engaged parallel to both the first lateral flap and the second lateral flap;

the top flap being coincident with the first lateral flap and the second lateral flap along a pivot path;

the first lateral flap being retained to the second lateral flap by way of an adhesive coupler;

the first lateral flap and the second lateral flap being retained to the bottom flap by way of another adhesive coupler;

the top flap being retained to the first lateral flap and the second lateral flap by way of an adhesive strip;

through engagements between the first lateral flap, the second lateral flap, the bottom flap, and the top flap, the inner chamber being completely enclosed; and the antimicrobial layer engaging used chewing gums deposited within the inner chamber.

* * * * *